US010683865B2

(12) United States Patent
Shaffer et al.

(10) Patent No.: US 10,683,865 B2
(45) Date of Patent: Jun. 16, 2020

(54) SCROLL TYPE DEVICE INCORPORATING SPINNING OR CO-ROTATING SCROLLS

(71) Applicant: Air Squared, Inc., Broomfield, CO (US)

(72) Inventors: Robert W Shaffer, Broomfield, CO (US); Bryce R Shaffer, Broomfield, CO (US); Russell Vigil, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 0 days.

(21) Appl. No.: 15/330,223

(22) Filed: Aug. 26, 2016

(65) Prior Publication Data

US 2017/0051741 A1 Feb. 23, 2017

Related U.S. Application Data

(63) Continuation-in-part of application No. 14/544,874, filed on Feb. 27, 2015, now Pat. No. 9,885,358, which
(Continued)

(51) Int. Cl.
*F03C 2/00* (2006.01)
*F03C 4/00* (2006.01)
(Continued)

(52) U.S. Cl.
CPC ..... *F04C 29/005* (2013.01); *F01C 1/0261* (2013.01); *F01C 17/063* (2013.01);
(Continued)

(58) Field of Classification Search
CPC .. F04C 29/005; F04C 18/023; F04C 15/0061; F04C 2240/50; F04C 2240/60;
(Continued)

(56) References Cited

U.S. PATENT DOCUMENTS 801,182 A 10/1905 Creux
2,079,118 A 5/1937 Hingst
(Continued)

FOREIGN PATENT DOCUMENTS

CN 105402134 3/2016
DE 460936 6/1928
(Continued)

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
(Continued)

*Primary Examiner* — Theresa Trieu
(74) *Attorney, Agent, or Firm* — Sheridan Ross P.C.

(57) ABSTRACT

A co-rotating scroll is disclosed having a motor having a shaft, a drive scroll connected to the shaft for moving the drive scroll, a driven scroll connected to the drive scroll to be moved by the drive scroll, and an idler shaft for aligning the drive scroll and the driven scroll and for allowing the driven scroll to be moved by the drive scroll.

20 Claims, 16 Drawing Sheets

Related U.S. Application Data is a continuation-in-part of application No. 13/987,486, filed on Jul. 30, 2013, now Pat. No. 9,028,230, which is a continuation-in-part of application No. 13/066,261, filed on Apr. 11, 2011, now Pat. No. 8,523,544, which is a continuation-in-part of application No. 12/930,140, filed on Dec. 29, 2010, now Pat. No. 8,668,479, which is a continuation-in-part of application No. 11/703,585, filed on Feb. 6, 2007, now Pat. No. 7,942,655.

(60) Provisional application No. 61/342,690, filed on Apr. 16, 2010, provisional application No. 61/336,035, filed on Jan. 16, 2010, provisional application No. 60/773,274, filed on Feb. 14, 2006.

(51) Int. Cl.

| | |
|---|---|
| ***F04C 18/00*** | (2006.01) |
| ***F04C 29/00*** | (2006.01) |
| ***F04C 18/02*** | (2006.01) |
| ***F04C 15/00*** | (2006.01) |
| ***F01C 1/02*** | (2006.01) |
| ***F01C 17/06*** | (2006.01) |
| ***F01C 21/00*** | (2006.01) |
| *F04C 23/00* | (2006.01) |

(52) U.S. Cl.
CPC ..... *F01C 21/008* (2013.01); *F04C 15/0061* (2013.01); *F04C 18/023* (2013.01); *F04C 23/008* (2013.01); *F04C 2240/50* (2013.01); *F04C 2240/60* (2013.01); *F04C 2240/80* (2013.01)

(58) Field of Classification Search
CPC .. F04C 2240/80; F04C 23/008; F01C 1/0261; F01C 17/063; F01C 21/008
USPC ..... 418/55.1–55.6, 57, 60, 151
See application file for complete search history.

(56) References Cited

U.S. PATENT DOCUMENTS

| | | | | |
|---|---|---|---|---|
| 2,330,121 | A | | 9/1943 | Heintz |
| 2,968,157 | A | | 1/1961 | Cronan |
| 3,011,694 | A | | 12/1961 | Mulhouse et al. |
| 3,470,704 | A | | 10/1969 | Kantor |
| 3,613,368 | A | | 10/1971 | Doerner |
| 3,802,809 | A | | 4/1974 | Vulliez |
| 3,842,596 | A | | 10/1974 | Gray |
| 3,986,799 | A | | 10/1976 | McCullough |
| 3,986,852 | A | | 10/1976 | Doerner et al. |
| 3,994,635 | A | | 11/1976 | McCullough |
| 3,994,636 | A | | 11/1976 | McCullough et al. |
| 3,999,400 | A | | 12/1976 | Gray |
| 4,065,279 | A | | 12/1977 | McCullough |
| 4,069,673 | A | | 1/1978 | Lapeyre |
| 4,082,484 | A | | 4/1978 | McCullough |
| 4,157,234 | A | | 6/1979 | Weaver et al. |
| 4,192,152 | A | | 3/1980 | Armstrong et al. |
| 4,300,875 | A | | 11/1981 | Fischer et al. |
| 4,340,339 | A | | 7/1982 | Hiraga et al. |
| 4,382,754 | A | | 5/1983 | Shaffer et al. |
| 4,395,885 | A | | 8/1983 | Cozby |
| 4,411,605 | A | | 10/1983 | Sauls |
| 4,415,317 | A | | 11/1983 | Buttersworth |
| 4,416,597 | A | | 11/1983 | Eber et al. |
| 4,436,495 | A | | 3/1984 | McCullough |
| 4,457,674 | A | | 7/1984 | Kawano et al. |
| 4,462,771 | A | | 7/1984 | Teegarden |
| 4,472,120 | A | | 9/1984 | McCullough |
| 4,477,238 | A | | 10/1984 | Terauchi |
| 4,511,091 | A | | 4/1985 | Vasco |
| 4,673,339 | A | | 6/1987 | Hayano et al. |
| 4,718,836 | A | | 1/1988 | Pottier et al. |
| 4,722,676 | A | | 2/1988 | Sugimoto |
| 4,726,100 | A | | 2/1988 | Etemad et al. |
| 4,730,375 | A | | 3/1988 | Nakamura et al. |
| 4,732,550 | A | | 3/1988 | Suzuki et al. |
| 4,802,831 | A | | 2/1989 | Suefuji et al. |
| 4,867,657 | A | | 9/1989 | Kotlarek et al. |
| 4,875,839 | A | | 10/1989 | Sakata et al. |
| 4,892,469 | A | | 1/1990 | McCullough et al. |
| 5,013,226 | A | * | 5/1991 | Nishida ..... F04C 29/0021 418/151 |
| 5,037,280 | A | | 8/1991 | Nishida et al. |
| 5,040,956 | A | | 8/1991 | Barito et al. |
| 5,044,904 | A | | 9/1991 | Richardson, Jr. |
| 5,051,079 | A | | 9/1991 | Richardson, Jr. |
| 5,082,430 | A | * | 1/1992 | Guttinger ..... F04C 18/0215 418/55.2 |
| 5,099,658 | A | | 3/1992 | Utter et al. |
| 5,108,274 | A | * | 4/1992 | Kakuda ..... F04C 29/0021 418/151 |
| 5,127,809 | A | | 7/1992 | Amata et al. |
| 5,142,885 | A | * | 9/1992 | Utter ..... F04C 18/0207 418/55.1 |
| 5,160,253 | A | | 11/1992 | Okada et al. |
| 5,214,932 | A | | 6/1993 | Abdelmalek |
| 5,222,882 | A | | 6/1993 | McCullough |
| 5,232,355 | A | | 8/1993 | Fujii et al. |
| 5,242,284 | A | * | 9/1993 | Mitsunaga ..... F04C 27/005 418/55.5 |
| 5,258,046 | A | | 11/1993 | Haga et al. |
| 5,338,159 | A | | 8/1994 | Riffe et al. |
| 5,417,554 | A | | 5/1995 | Kietzman et al. |
| 5,449,279 | A | | 9/1995 | Hill et al. |
| 5,466,134 | A | | 11/1995 | Shaffer et al. |
| 5,496,161 | A | | 3/1996 | Machida et al. |
| 5,609,478 | A | | 3/1997 | Utter et al. |
| 5,616,015 | A | | 4/1997 | Liepert |
| 5,632,612 | A | | 5/1997 | Shaffer |
| 5,632,613 | A | | 5/1997 | Shin et al. |
| 5,752,816 | A | | 5/1998 | Shaffer |
| 5,759,020 | A | | 6/1998 | Shaffer |
| 5,803,723 | A | | 9/1998 | Suefuji et al. |
| 5,836,752 | A | | 11/1998 | Calhoun et al. |
| 5,842,843 | A | | 12/1998 | Haga |
| 5,855,473 | A | | 1/1999 | Liepert |
| 5,857,844 | A | | 1/1999 | Lifson et al. |
| 5,873,711 | A | | 2/1999 | Lifson |
| 5,938,419 | A | | 8/1999 | Honma et al. |
| 5,951,268 | A | | 9/1999 | Pottier et al. |
| 5,961,297 | A | | 10/1999 | Haga et al. |
| 5,987,894 | A | | 11/1999 | Claudet |
| 6,008,557 | A | | 12/1999 | Dornhoefer et al. |
| 6,050,792 | A | | 4/2000 | Shaffer |
| 6,068,459 | A | | 5/2000 | Clarke et al. |
| 6,074,185 | A | | 6/2000 | Protos |
| 6,129,530 | A | | 10/2000 | Shaffer |
| 6,179,590 | B1 | * | 1/2001 | Honma ..... F04C 18/0215 418/55.1 |
| 6,186,755 | B1 | | 2/2001 | Haga |
| 6,190,145 | B1 | | 2/2001 | Fujioka et al. |
| 6,193,487 | B1 | | 2/2001 | Ni |
| 6,283,737 | B1 | | 9/2001 | Kazikis et al. |
| 6,379,134 | B2 | | 4/2002 | Iizuka |
| 6,434,943 | B1 | | 8/2002 | Garris |
| 6,439,864 | B1 | | 8/2002 | Shaffer |
| 6,464,467 | B2 | | 10/2002 | Sullivan et al. |
| 6,511,308 | B2 | | 1/2003 | Shaffer |
| 6,712,589 | B2 | | 3/2004 | Mori et al. |
| 6,736,622 | B1 | | 5/2004 | Bush et al. |
| 6,905,320 | B2 | | 6/2005 | Satoh et al. |
| 6,922,999 | B2 | | 8/2005 | Kimura et al. |
| 7,124,585 | B2 | | 10/2006 | Kim et al. |
| 7,249,459 | B2 | | 7/2007 | Hisanaga et al. |
| 7,306,439 | B2 | | 12/2007 | Unami et al. |
| 7,314,358 | B2 | | 1/2008 | Tsuchiya |
| 7,458,152 | B2 | | 12/2008 | Sato |
| 7,458,414 | B2 | | 12/2008 | Simon |
| 7,836,696 | B2 | | 11/2010 | Uno et al. |

(56) References Cited

U.S. PATENT DOCUMENTS

| | | | | |
|---|---|---|---|---|
| 7,942,655 | B2 | 5/2011 | Shaffer | |
| 7,980,078 | B2 | 7/2011 | McCutchen et al. | |
| 8,007,260 | B2 | 8/2011 | Yanagisawa | |
| 8,087,260 | B2 | 1/2012 | Ogata et al. | |
| 8,186,980 | B2 | 5/2012 | Komai et al. | |
| 8,328,544 | B2 | 12/2012 | Iwano et al. | |
| 8,484,974 | B1 | 7/2013 | Monson et al. | |
| 8,523,544 | B2 | 9/2013 | Shaffer | |
| 8,668,479 | B2 | 3/2014 | Shaffer | |
| 8,674,525 | B2 | 3/2014 | Van Den Bossche et al. | |
| 9,022,758 | B2 | 5/2015 | Roof et al. | |
| 9,028,230 | B2 | 5/2015 | Shaffer | |
| 9,074,598 | B2 | 7/2015 | Shaffer et al. | |
| 9,657,733 | B2 | 5/2017 | Chadwick et al. | |
| 9,784,139 | B2 | 10/2017 | Shaffer et al. | |
| 9,885,358 | B2 | 2/2018 | Shaffer | |
| 10,221,852 | B2 | 3/2019 | Shaffer et al. | |
| 2001/0043878 | A1 | 11/2001 | Sullivan et al. | |
| 2002/0011332 | A1 | 1/2002 | Oh et al. | |
| 2002/0071779 | A1 | 6/2002 | Moroi et al. | |
| 2003/0017070 | A1 | 1/2003 | Moroi et al. | |
| 2003/0138339 | A1 | 7/2003 | Scancarello | |
| 2003/0223898 | A1* | 12/2003 | Fujioka | F04C 18/0207 418/55.3 |
| 2004/0020206 | A1 | 2/2004 | Sullivan et al. | |
| 2004/0255591 | A1 | 12/2004 | Hisanga et al. | |
| 2005/0031469 | A1 | 2/2005 | Yanagisawa et al. | |
| 2006/0016184 | A1 | 1/2006 | Simon | |
| 2006/0045783 | A1 | 3/2006 | Yanagisawa et al. | |
| 2006/0130495 | A1 | 6/2006 | Dieckmann et al. | |
| 2007/0108934 | A1 | 5/2007 | Smith et al. | |
| 2007/0172373 | A1 | 7/2007 | Ni | |
| 2007/0231174 | A1 | 10/2007 | Ishizuki | |
| 2008/0159888 | A1 | 7/2008 | Nakayama et al. | |
| 2008/0193311 | A1 | 8/2008 | Helies | |
| 2009/0148327 | A1 | 6/2009 | Carter et al. | |
| 2009/0246055 | A1 | 10/2009 | Stehouwer et al. | |
| 2010/0111740 | A1 | 5/2010 | Ni | |
| 2010/0254835 | A1 | 10/2010 | Kane et al. | |
| 2010/0287954 | A1 | 11/2010 | Harman et al. | |
| 2011/0129362 | A1 | 6/2011 | Kameya et al. | |
| 2012/0134862 | A1* | 5/2012 | Hockliffe | F04C 18/0215 418/55.1 |
| 2013/0232975 | A1 | 9/2013 | Shaffer et al. | |
| 2014/0023540 | A1 | 1/2014 | Heidecker et al. | |
| 2017/0045046 | A1 | 2/2017 | Afshari | |
| 2017/0074265 | A1 | 3/2017 | Asami et al. | |
| 2017/0268514 | A1 | 9/2017 | Shaffer | |
| 2017/0362962 | A1 | 12/2017 | Shaffer et al. | |
| 2018/0163725 | A1 | 6/2018 | Valdez et al. | |
| 2018/0163726 | A1 | 6/2018 | Shaffer et al. | |
| 2018/0216498 | A1 | 8/2018 | Shaffer et al. | |
| 2019/0211824 | A1 | 7/2019 | Shaffer et al. | |

FOREIGN PATENT DOCUMENTS

| | | |
|---|---|---|
| DE | 19957425 | 8/2000 |
| EP | 0513824 | 11/1992 |
| EP | 0780576 | 6/1997 |
| EP | 3239526 | 11/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | H05-157076 | 6/1993 |
| JP | H07-109981 | 4/1995 |
| JP | H07-324688 | 12/1995 |
| WO | WO 2004/008829 | 1/2004 |
| WO | WO 2009/050126 | 4/2009 |
| WO | WO 2015/164453 | 10/2015 |

OTHER PUBLICATIONS

"Involute," Wikipedia, last modified Jun. 2, 2012, 5 pages [retrieved online from: en.wikipedia.org/wiki/Involute].
"Oldham Coupler," Wikipedia, last modified, Feb. 9, 2010, 2 pages [retrieved online from: en.wikipedia.org/wiki/Oldham_coupler].
"Organic Rankine Cycle," Wikipedia, last modified May 19, 2013, 4 pages [retrieved online from: en.wikipedia.org/wiki/Organic_Rankine_Cycle].
"Rankine Cycle," Wikipedia, last modified Apr. 29, 2013, 4 pages [retrieved online from: en.wikipedia.org/wiki/Rankine_cycle].
"Scroll Compressor," Wikipedia, last modified Apr. 24, 2013, 3 pages [retrieved online from: en.wikipedia.org/wiki/Scroll_compressor].
"Thrust Bearing," Wikipedia, last modified Dec. 19, 2012, 2 pages [retrieved online from: en.wikipedia.org/wiki/Thrust_bearing].
International Search Report and Written Opinion for Interiantional (PCT) Patent Application No. PCT/US2018/064427, dated Feb. 5, 2019 14 pages.
International Search Report for International (PCT) Patent Application No. PCT/US01/43523, dated Jun. 5, 2002 1 page.
International Search Report for International (PCT) Patent Application No. PCT/US01/50377, dated May 13, 2002 1 page.
Partial Search Report for European Patent Application No. 13003663.5, dated May 28, 2014 5 pages.
Extended Search Report for European Patent Application No. 13003663.5, dated Sep. 3, 2014 11 pages.
International Search Report and Written Opinion for International (PCT) Patent Application No. PCT/US14/00076, dated Dec. 17, 2014 6 pages.
International Search Report and Written Opinion for International (PCT) Patent Application No. PCT/US18/00118, dated Sep. 24, 2018 19 pages.
Official Action for U.S. Appl. No. 11/703,585, dated Dec. 18, 2009 7 pages.
Official Action for U.S. Appl. No. 11/703,585, dated Jul. 20, 2010 7 pages.
Notice of Allowance for U.S. Appl. No. 11/703,585, dated Feb. 4, 2011 4 pages.
Official Action for U.S. Appl. No. 12/930,140, dated Jan. 14, 2013 22 pages.
Official Action for U.S. Appl. No. 12/930,140, dated Jun. 13, 2013 21 pages.
Notice of Allowance for U.S. Appl. No. 12/930,140, dated Oct. 24, 2013 12 pages.
Official Action for U.S. Appl. No. 13/066,261, dated Feb. 11, 2013 5 pages Restriction Requirement.
Notice of Allowance for U.S. Appl. No. 13/066,261, dated Apr. 4, 2013 13 pages.
Official Action for U.S. Appl. No. 13/987,486, dated Dec. 16, 2013 5 pages Restriction Requirement.
Official Action for U.S. Appl. No. 13/987,486, dated Apr. 23, 2014 13 pages.
Official Action for U.S. Appl. No. 13/987,486, dated Oct. 20, 2014 11 pages.
Notice of Allowance for U.S. Appl. No. 13/987,486, dated Jan. 5, 2015 5 pages.
Corrected Notice of Allowance for U.S. Appl. No. 13/987,486, dated Feb. 20, 2015 8 pages.
Official Action for U.S. Appl. No. 14/544,874, dated Dec. 23, 2016 5 pages Restriction Requirement.
Official Action for U.S. Appl. No. 14/544,874, dated Jan. 26, 2017 9 pages.
Official Action for U.S. Appl. No. 14/544,874, dated Jul. 21, 2017 6 pages.
Notice of Allowance for U.S. Appl. No. 14/544,874, dated Sep. 28, 2017 5 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.

(56) References Cited

OTHER PUBLICATIONS

Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Official Action for U.S. Appl. No. 15/373,979, dated Jan. 29, 2019 12 pages.
"Digital Scroll Compressor Technology," Wikipedia, 2010, 3 pages [retrieved online from: en.wikipedia.org/wiki/Digital_Scroll_Compressor_Technology].
Official Action for U.S. Appl. No. 15/731,929, dated Jun. 4, 2019 10 pages.
Notice of Allowance for U.S. Appl. No. 15/731,929, dated Aug. 14, 2019 9 pages.
Notice of Allowance for U.S. Appl. No. 15/731,324, dated Aug. 2, 2019 11 pages.
Notice of Allowance for U.S. Appl. No. 15/373,979, dated Apr. 26, 2019 9 pages.

* cited by examiner

SCROLL TYPE DEVICE INCORPORATING SPINNING OR CO-ROTATING SCROLLS

CROSS REFERENCE TO RELATED APPLICATION

This regular letters patent application claims priority to the provisional patent application having Ser. No. 62/283,435, filed on Sep. 1, 2015; and this application claims priority as a continuation-in-part patent application to the patent application having Ser. No. 14/999,427, filed on May 4, 2016, which claims priority to the provisional patent application having Ser. No. 62/179,437, filed on May 7, 2015; and this patent application claims priority as a continuation-in-part to the non-provisional patent application having Ser. No. 14/544,874, filed on Feb. 27, 2015; which claims priority as a continuation-in-part patent application to the patent application having Ser. No. 13/987,486, filed on Jul. 30, 2013, which claims priority to the non-provisional patent application having Ser. No. 13/066,261, filed on Apr. 11, 2011, now U.S. Pat. No. 8,523,544, which claims priority to the provisional patent application having Ser. No. 61/342,690, filed on Apr. 16, 2010, which claims priority to the non-provisional patent application having Ser. No. 12/930,140, filed on Dec. 29, 2010, now U.S. Pat. No. 8,668,479, which claims priority to the provisional patent application having Ser. No. 61/336,035, filed on Jan. 16, 2010, which claims priority to the non-provisional patent application having Ser. No. 14/703,585, filed on Feb. 6, 2007, now U.S. Pat. No. 7,942,655, which claims priority to the provisional patent application having Ser. No. 60/773,274, filed on Feb. 14, 2006.

BACKGROUND OF THE DISCLOSURE

This disclosure relates to a scroll type device and more particularly to spinning or co-rotating scroll devices that are capable of operating at high speeds, but yet are small of structure.

Scroll devices have been used as compressors, pumps, vacuum pumps, and expanders for many years. In general, they have been limited to a single stage of compression due to the complexity of two or more stages. In a single stage, a spiral involute or scroll upon a rotating plate orbits within a fixed spiral or scroll upon a stationary plate. A motor shaft turns a shaft that orbits a scroll eccentrically within a fixed scroll. The eccentric orbit forces a gas through and out of the fixed scroll thus creating a vacuum in a container in communication with the fixed scroll. An expander operates with the same principle only turning the scrolls in reverse. When referring to compressors, it is understood that a vacuum pump can be substituted for the compressor and that an expander can be an alternate usage when the scrolls operate in reverse from an expanding gas.

Scroll type compressors and vacuum pumps of the orbiting type have also been used for many years. Orbiting type scroll compressors are typically limited in their maximum speed to under 4000 rpm (revolutions per minute) due to the unbalanced centrifugal forces that must be contained by bearings. This relatively low speed results in relatively large scroll devices. Higher speed scrolls that are also smaller and lighter weight are desirable for some applications. For example, having a small, lightweight, high speed scroll would be advantageous in aerospace applications and for portable medical equipment.

The present disclosure overcomes the limitations of the prior art where a need exists for higher speed equipment of compact form. The present disclosure provides a co-rotating scroll that can operate at high speeds such as 6000 rpm and higher.

SUMMARY OF THE DISCLOSURE

Accordingly, the present disclosure is a co-rotating scroll that comprises a motor having a shaft, a drive scroll connected to the shaft for moving the drive scroll, a driven scroll connected to the drive scroll to be moved by the drive scroll, and three idler shafts for aligning the drive scroll and the driven scroll and for allowing the driven scroll to be moved by the drive scroll.

Other co-rotating scrolls are disclosed such as a co-rotating scroll comprising a motor having a shaft, a drive scroll connected to the shaft for moving the drive scroll, a driven scroll connected to the drive scroll to be moved by the drive scroll, and an idler shaft for aligning the drive scroll and the driven scroll and for allowing the driven scroll to be moved by the drive scroll, the idler shaft having a hole therein and a bearing, the hole for reducing centrifugal force on the bearing. A co-rotating scroll comprising a motor having a shaft, a drive scroll connected to the shaft for moving the drive scroll, a driven scroll connected to the drive scroll to be moved by the drive scroll, and an idler shaft for aligning the drive scroll and the driven scroll and for allowing the driven scroll to be moved by the drive scroll, the idler shaft having a bearing having a bearing cover and a bearing shield for retaining grease within the bearing is also disclosed. Further, a co-rotating scroll is shown that comprises a motor having a shaft, a drive scroll connected to the shaft for moving the drive scroll, a driven scroll connected to the drive scroll to be moved by the drive scroll, and a bellows for aligning the drive scroll and the driven scroll and for allowing the driven scroll to be moved by the drive scroll.

Therefore, the present disclosure provides a new and improved co-rotating scroll device from the machine class of compressors, vacuum pumps, and expanders for gases.

The present disclosure provides an enclosed housing for the co-rotating scrolls.

The present disclosure also provides a co-rotating scroll device that is capable of greater speeds as compared to other scroll type devices of similar size.

The present disclosure provides a construction and a method for alignment of a drive scroll with respect to a driven scroll during the assembly process.

The present disclosure relates to a co-rotating scroll device that uses smaller sized bearings than compared to other scroll type devices of similar size.

The present disclosure provides a co-rotating scroll device that has idler shafts that reduce the centrifugal force on bearings contained within the co-rotating scroll device so that the useful life of the bearings is increased.

The present disclosure also provides a magnetic coupling that separates the working fluid from the ambient atmosphere.

Also, the present disclosure provides a co-rotating scroll device that employs bearing covers and bearing shields for grease retention.

The present co-rotating scroll device has tapered tip seals that are self-actuating in the axial direction by way of the centrifugal forces acting on the tapered tip seals.

The present disclosure is further directed to a co-rotating scroll device that uses a labyrinth lip seal or mechanical face seal type seal to seal discharge or inlet gas.

The present disclosure is directed to a co-rotating scroll device that has a pre-loaded shaft bearing to reduce the axial load on an idler shaft bearing.

The present disclosure is also directed to a co-rotating scroll device that employs a flexible bellows instead of idler shafts to drive and align one scroll with respect to another scroll.

These and other advantages may become more apparent to those skilled in the art upon review of the disclosure as described herein, and upon undertaking a study of the description of its preferred embodiment, when viewed in conjunction with the drawings.

BRIEF DESCRIPTION OF THE DRAWINGS

FIGS. 15 and 15A shows a side view of driven scroll used in the co-rotating scroll shown in FIG. 13.

DESCRIPTION OF THE PREFERRED EMBODIMENT

Figure 1:
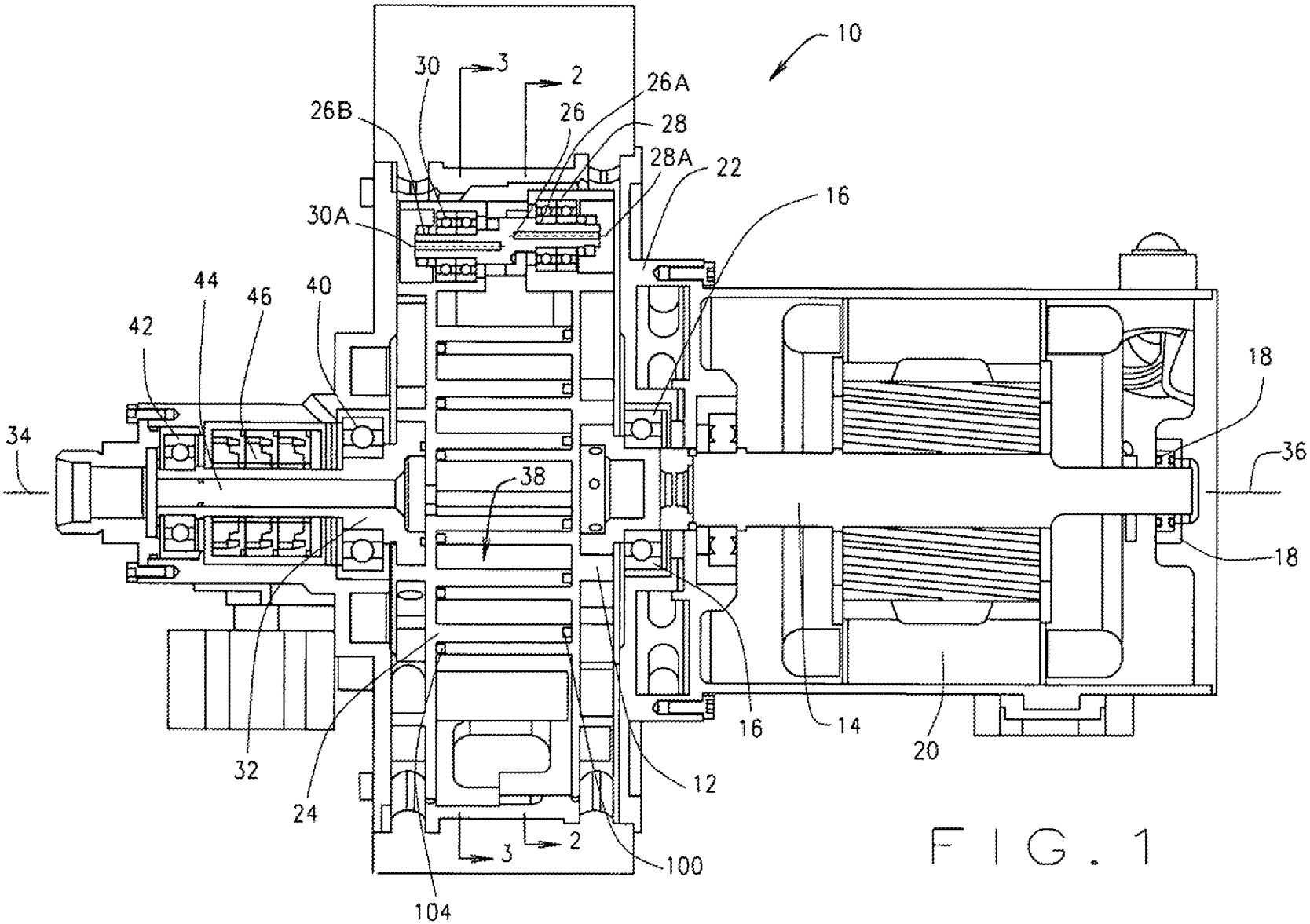
FIG. 1 shows a sectional view through a motor and a scroll center line of a co-rotating scroll with an idler type alignment between the co-rotating scrolls.

Referring now to the drawings, wherein like numbers refer to like items, number 10 identifies a preferred embodiment of a co-rotating scroll device constructed according to the present disclosure. In FIG. 1, the co-rotating scroll device 10 is shown to comprise a drive scroll 12 which is driven by a center shaft 14. The center shaft 14 is supported by a front bearing 16 and a rear bearing 18. An electric motor 20 is used to drive the center shaft 14. The bearings 16 and 18 and the electric motor 20 are mounted in a housing 22. A second scroll or driven scroll 24 is driven by the drive scroll 12 through the use of idler shafts 26, of which only one idler shaft 26 is shown in this view. By way of example there may be three idler shafts 26 that are spaced 120° apart. The idler shaft 26 comprises a first portion 26A that is supported by a first bearing 28 (which has a centerline 28A) in the drive scroll 12, and a second portion 26B that is supported by a second bearing 30 (which has a centerline 30A) in the driven scroll 24. A shaft 32 is connected to the driven scroll 24. A center line 34 of the shaft 32 is offset from a center line 36 of the center shaft 14. The center line 34 being offset as compared to the center line 36 is used to form a compression chamber 38. The shaft 32 is supported by a first shaft bearing 40 and a second shaft bearing 42. The shaft 32 has a center opening 44 formed therein for discharging a working fluid as in the case where the co-rotating scroll 10 is a compressor or a vacuum pump. The center opening 44 may also function as an inlet in the case where the co-rotating scroll 10 is an expander. To seal any working fluid within the center opening 44 of the shaft 32 a labyrinth seal 46 is used. The labyrinth seal 46 is positioned between the first bearing 40 and the second bearing 42.

Figure 2:
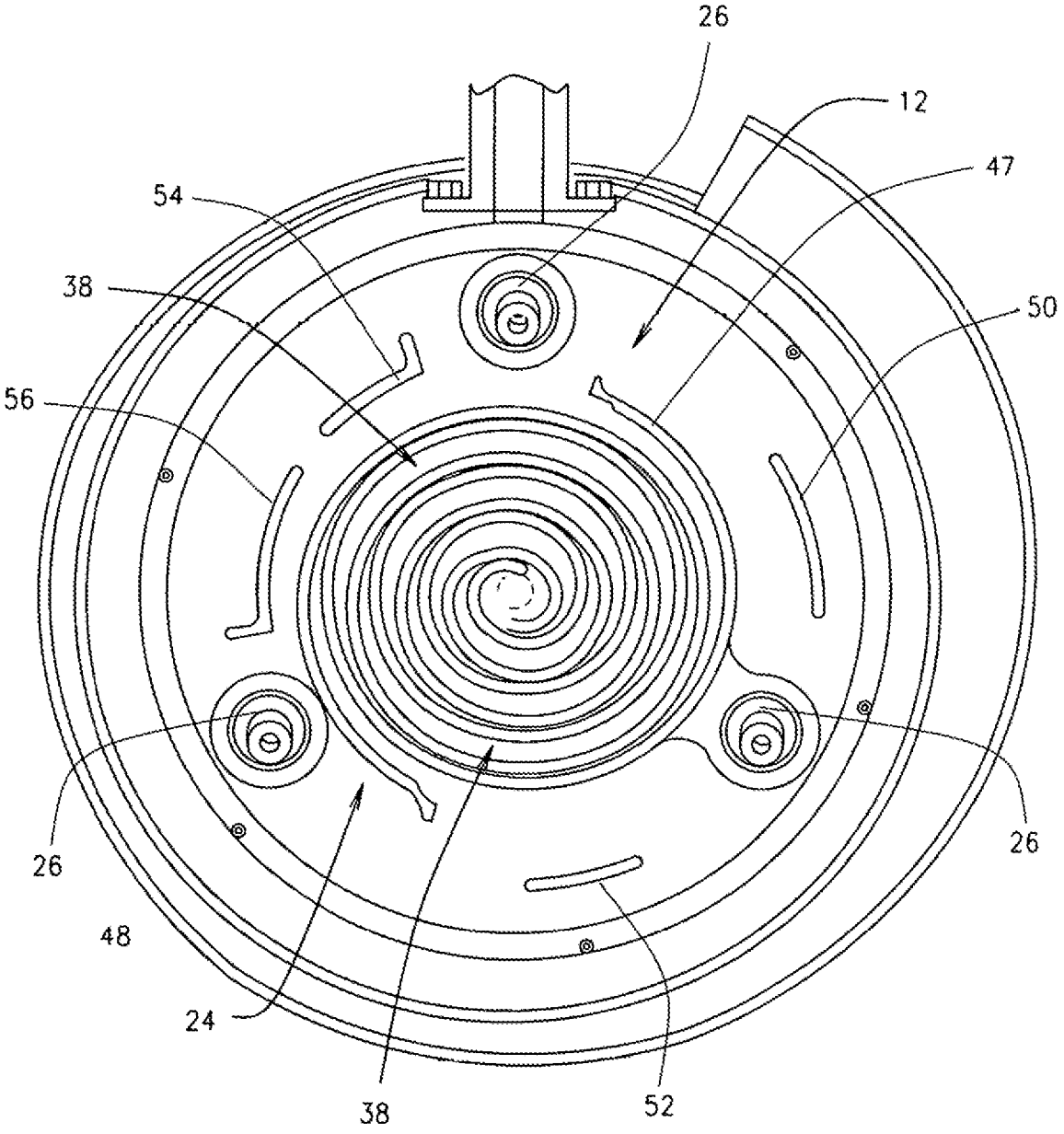
FIG. 2 shows a sectional view of the co-rotating scrolls taken along the plane of line 2-2 of FIG. 1.

FIG. 2 illustrates a cross-sectional view of the co-rotating scroll 10 taken along the plane of line 2-2 of FIG. 1. The co-rotating scroll 10 has the compression chamber 38 formed between the drive scroll 12 and the driven scroll 24. The compression chamber 38 is also formed by a first involute 47 on the drive scroll 12 and a second involute 48 on the driven scroll 24. The three idler shafts 26 are shown being positioned approximately 120° apart. In order to balance the rotary motion of the drive scroll 12 a pair of balance weights 50 and 52 are located co-axially with the first involute 47 to dynamically balance the drive scroll 12. Also, a pair of counterweights 54 and 56 are positioned on the driven scroll 24 to dynamically balance the driven scroll 24.

Figure 3:
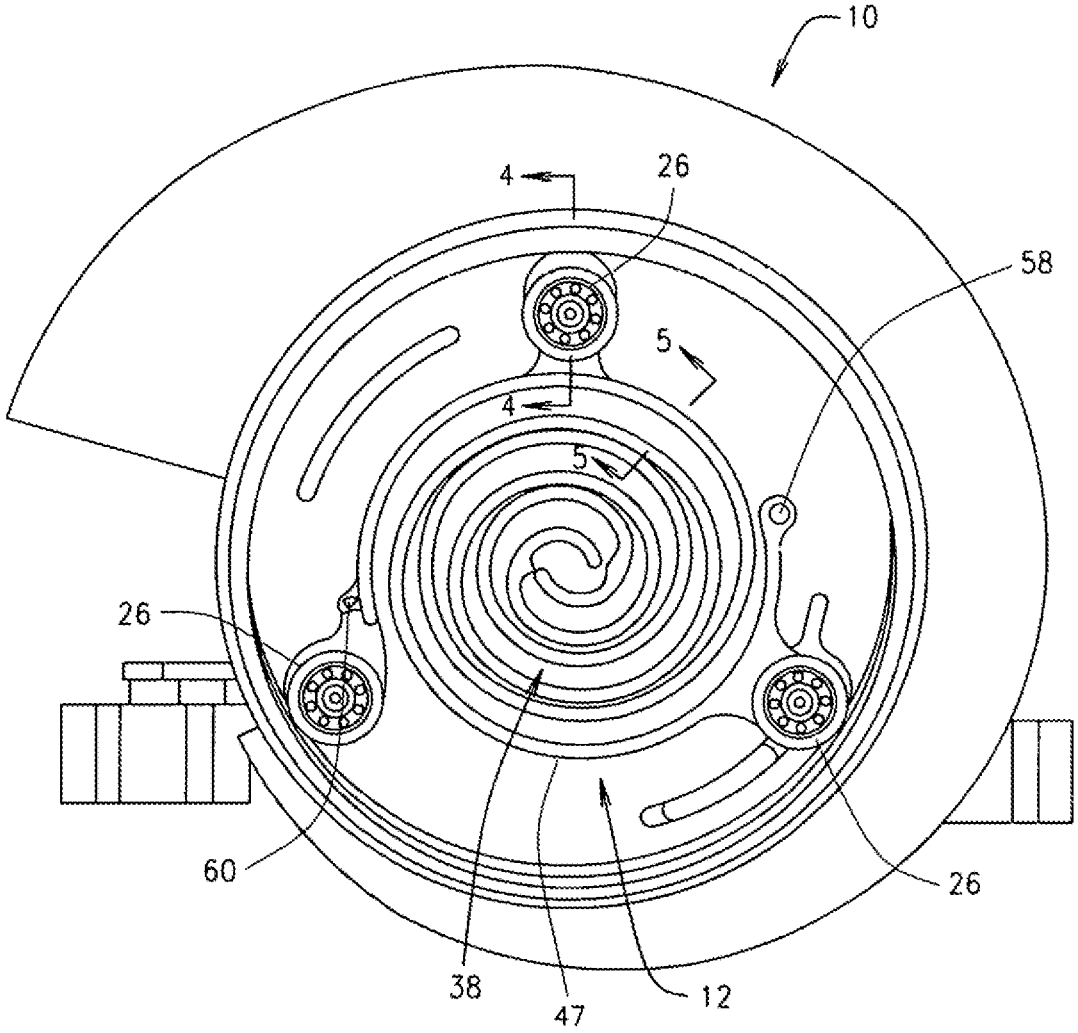
FIG. 3 shows all alternative sectional view of the co-rotating scrolls taken along the plane of line 3-3 of FIG. 1.

With reference now to FIG. 3, another cross-sectional view of the co-rotating scroll 10 is shown which is taken along the plane of line 3-3 of FIG. 1. In this particular view the co-rotating scroll 10 has the compression chamber 38 formed between the drive scroll 12 and the driven scroll 24. The compression chamber 38 is also formed by a first involute 47 on the drive scroll 12 and a second involute 48 on the driven scroll 24. As is known, a working fluid (not shown) may enter from the drive scroll 12 make its way around the first involute 47 to be transferred through the second involute 48 of the driven scroll 24 to pass through the center opening 44 (FIG. 1) of the shaft 32 (FIG. 1). The three idler shafts 26 are shown being positioned approximately 120° apart. The co-rotating scroll 10 also has a pair of holes or first and second alignment apertures 58 and 60 that are used for alignment purposes during assembly of the co-rotating scroll 10, as will be explained more fully herein.

Figure 4A:
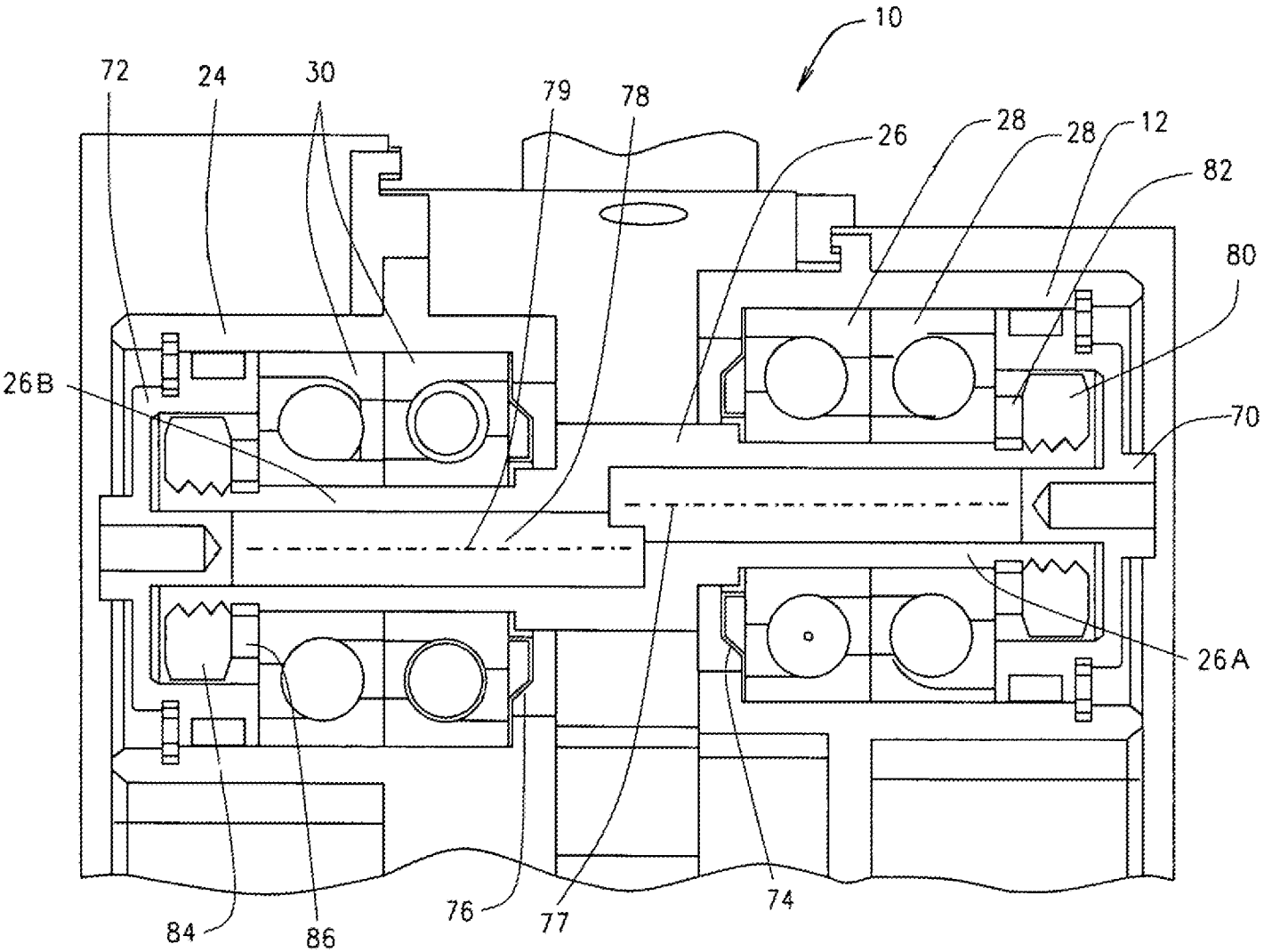
FIG. 4A shows an Idler shaft construction which includes bearing covers for retaining bearing grease on the outboard side of the idler shaft bearings and bearing shields for grease retention on the inboard side of the bearings.

FIG. 4A depicts one of the idler shafts 26, comprising a first portion 26*a* and a second portion 26*b* offset from the first portion 26*a*. The idler shaft 26 has the first grease bearing 28 and the second grease bearing 30 retained in place by use of a first bearing cover 70 in the drive scroll 12 and a second bearing cover 72 in the driven scroll 24. The first grease bearing 28 has a centerline 77 and also has a bearing shield 74. The second grease bearing 30 has a centerline 79 and also has a bearing shield 76. The shields 74 and 76 are used to retain any grease contained within the grease bearings 28 and 30. The idler shaft 26 may have a channel, hole, or opening 78 formed therein to provide for a lighter idler shaft 26. The lighter weight idler shaft 26 reduces the load from centrifugal force on the bearings 28 and 30. The idler shaft 26 is retained on the bearing 28 by use of a lock nut 80 and a lock washer 82. The bearing 30 also has a lock nut 84 and a lock washer 86.

Figure 4B:
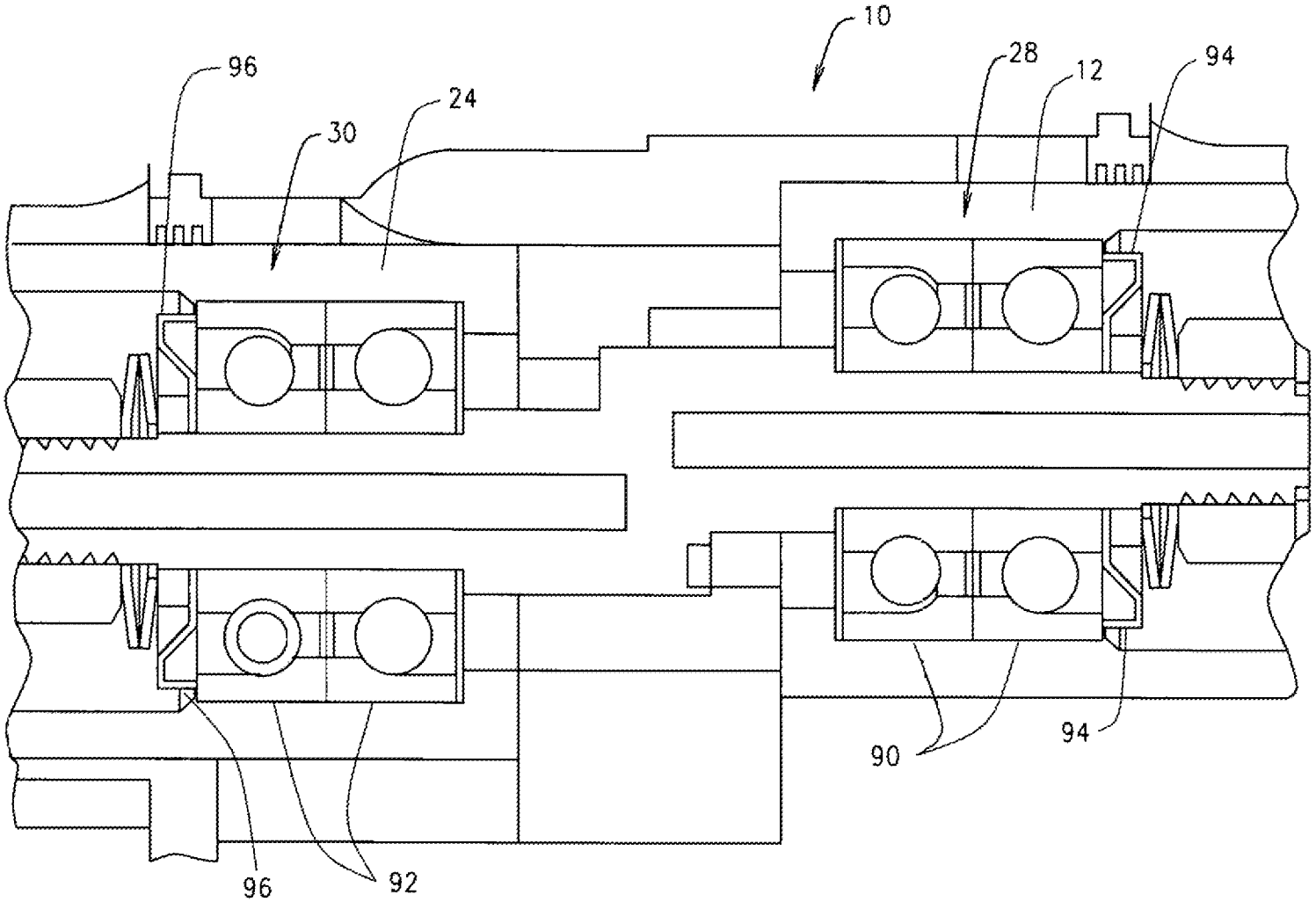
FIG. 4B shows an alternate view of a bearing shield used for grease retention on the outboard side of the idler shaft bearings.

With reference now to FIG. 4B, an alternative embodiment of a first grease bearing 90 and a second grease bearing 92 are shown. In this embodiment, the first grease bearing 90 has a bearing shield 94 in the drive scroll 12 instead of the first bearing cover 70. The second grease bearing 92 also has a bearing shield 96 in the driven scroll 24 instead of the second bearing cover 72.

Figure 5:
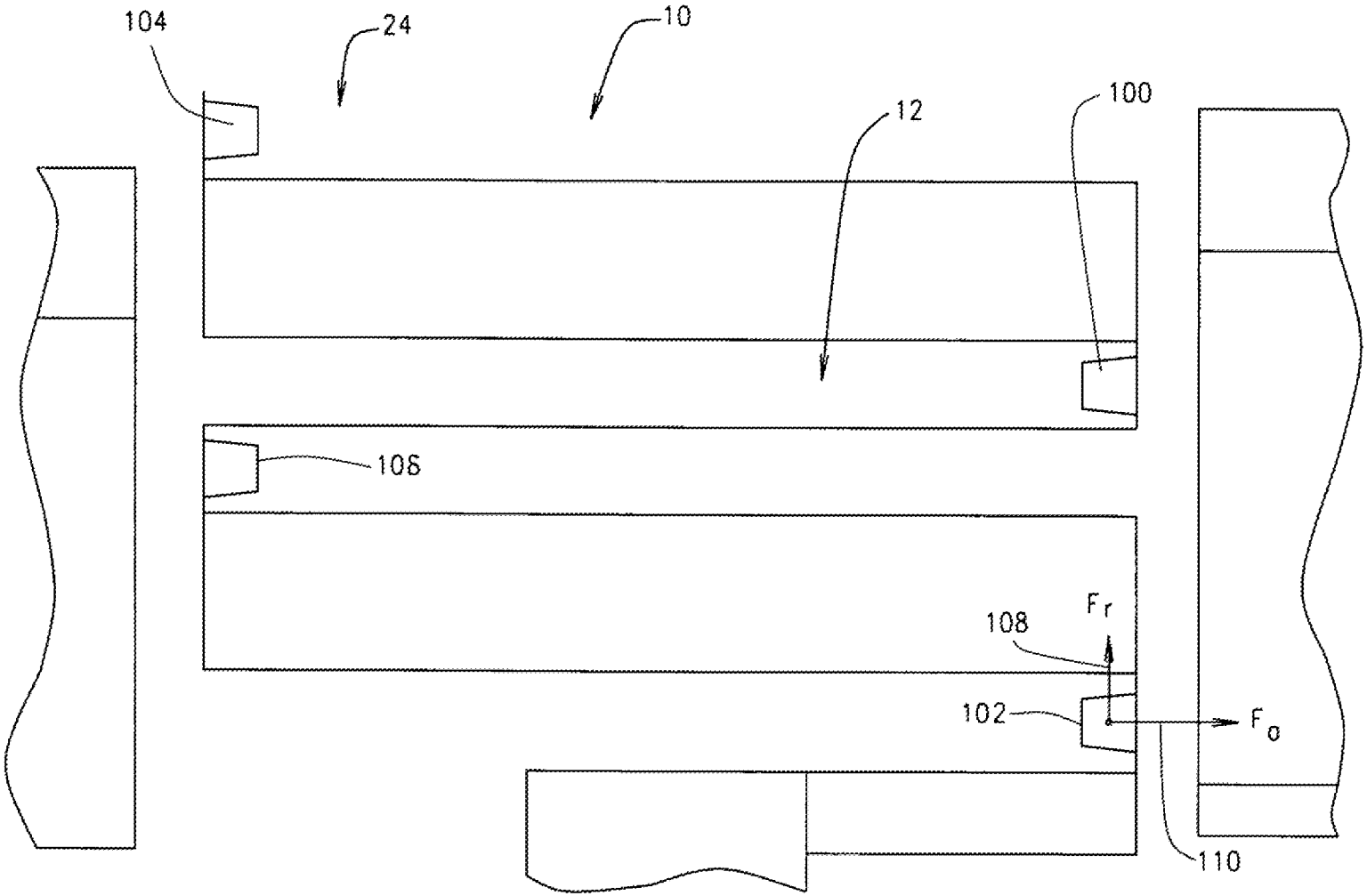
FIG. 5 shows a sectional view of a tip seal taken along the plane of line 5-5 of FIG. 3.

FIG. 5 shows the co-rotating scroll 10 with the drive scroll 12 having a pair of tapered tip seals 100 and 102 and the driven scroll 24 having a pair of tapered tip seals 104 and 106. The tapered seals 100, 102, 104, and 106 will each have centrifugal forces acting radially outward. This is shown as an arrow 108. The seals 100, 102, 104, and 106 will each also have a force in an axial direction. This indicated by an arrow 110. The force in the axial direction 110 will self-actuate the tip seals 100, 102, 104, and 106. The tip seals 100 and 104 are also shown in FIG. 1. Further, as illustrated in FIG. 1, there may be more than the four tip seals 100, 102, 104, and 106 which are shown in FIG. 5. The tips seals 100, 102, 104, and 106 are used to form a gas tight chamber, such as the compression chamber 38, as the scrolls 12 and 24 mesh together.

The idler shafts 26 of the co-rotating scroll 10 are used to align the driven scroll 24 relative to the drive scroll 12. The channel 78 in each of the idler shafts 26 is used to reduce the centrifugal force on the bearings 28 and 30. Reducing the centrifugal force will provide longer life for the bearings 28 and 30. The bearings covers 70 and 72 and the bearings shields 74, 76. 94, and 96 allow for the retention of any grease in the bearings 28 and 30. This also provides for longer life for the bearings 28 and 30. The weights 50 and 52 and the counterweights 54 and 56 provide for the ability to dynamically balance the scrolls 12 and 24. The tapered tip seals 100, 102, 104, and 106 are self-actuating in the axial direction by way of the centrifugal force acting on the seals 100, 102, 104, and 106. Also, the labyrinth seal 46 insures that any discharge gas or inlet gas is limited to flow through the center opening 44.

Figure 6:
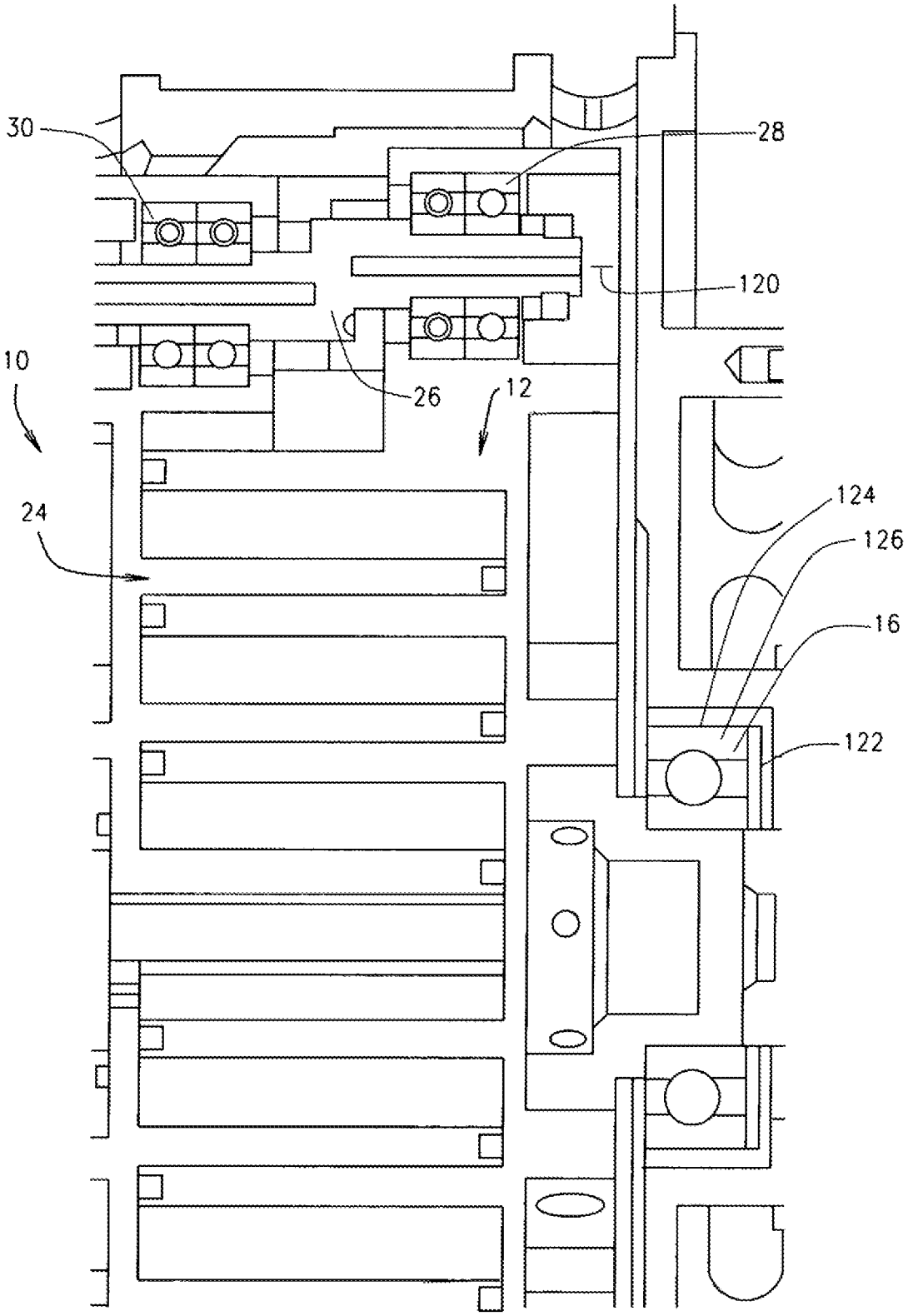
FIG. 6 shows a sectional view of a pre-load spring used for pre-loading a bearing.

FIG. 6 illustrates how the idler shaft bearings 28 and 30 may have a reduced axial load to prolong the life of the bearings 28 and 30. The idler shaft bearing 28 rotates about a center line 120 of the drive scroll 12. The mass of the idler shaft bearing 28 is a major radial load on the bearing 28 due to centrifugal forces. If the bearing 28 is smaller then a smaller centrifugal force will be placed on the bearing 28. This will provide a longer life for the bearing 28. Since the axial thrust from pressure on the drive scroll 12 and the driven scroll 24 must be supported, it would be beneficial to reduce the amount of this axial load that must be borne by the bearings 28 and 30. In order to reduce the amount of the axial load a pre-load spring 122 is used with the front bearing 16. The front bearing 16 has a small clearance 124 on the an outside diameter 126. The pre-load spring 122 will place a small negative load on the idler shaft bearings 28 and 30. In operation, the pre-load force from the spring 122 must be overcome before any positive force is placed on the bearings 28 and 30. The resulting axial load on the bearings 28 and 30 is reduced so that the bearings 28 and 30 can be made smaller and lighter. By way of example only, the spring 122 may be a wave washer or a Bellville washer. Again, having smaller and lighter bearings 28 and 30 will increase the longevity of the bearings 28 and 30.

Figure 7:
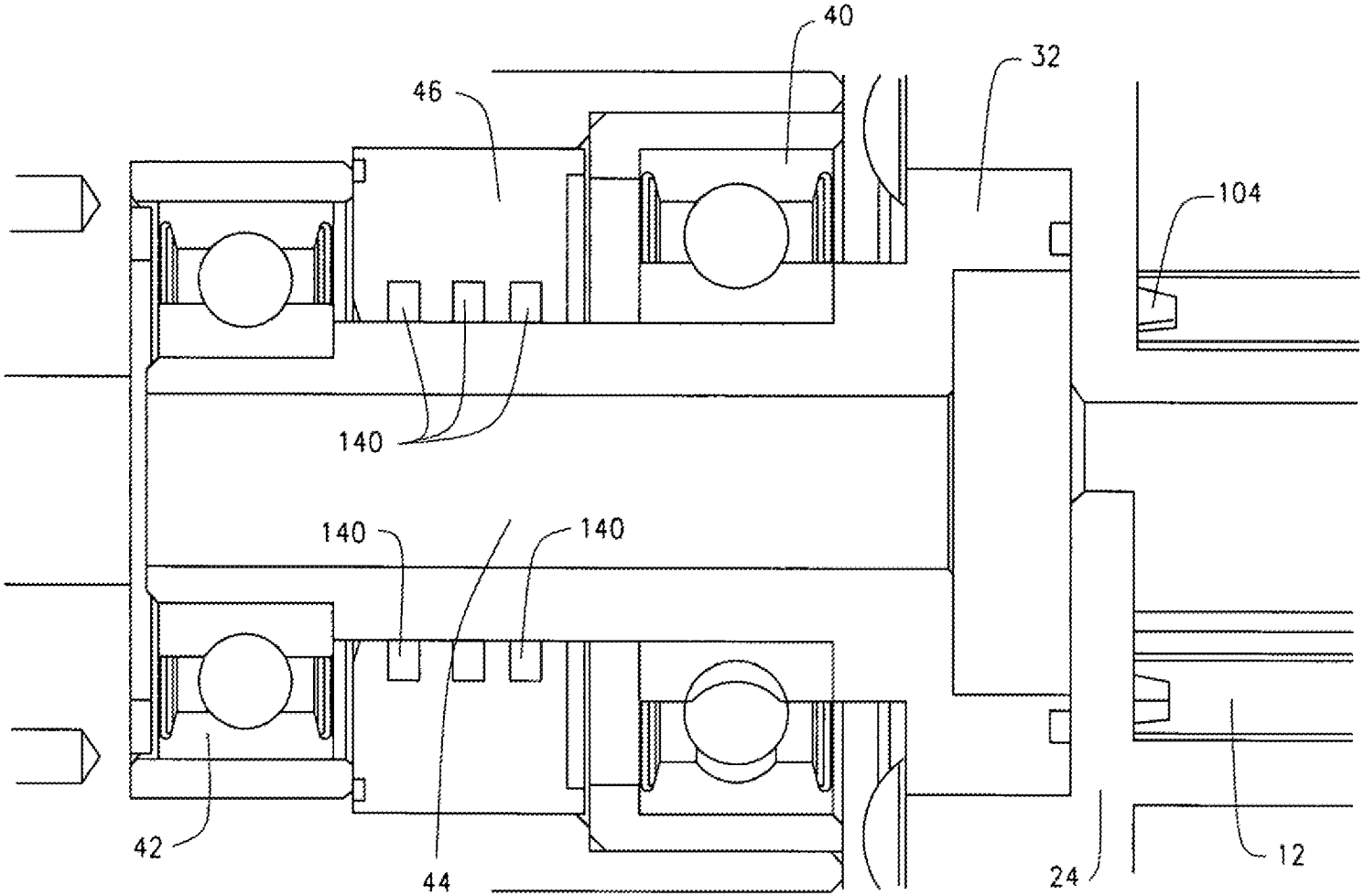
FIG. 7 shows a sectional view of a labyrinth shaft seal on a shaft of a discharge of the co-rotating scroll device of the present disclosure.

With particular reference now to FIG. 7, the labyrinth seal 46 is shown surrounding the shaft 32. The seal 46 is a mechanical seal that provides a twisted or tortuous path to help prevent any leakage. The seal 46 may include grooves 140 that provide a difficult path that a fluid must pass through in order to escape the seal 46. The seal 46 does not contact the shaft 32 and the seal 46 does not wear out. The seal 46 is used to seal any working fluid (not shown) that flows in the center opening 44 formed in the shaft 32. The seal 46 is also mounted between the first shaft bearing 40 and the second shaft bearing 42. Since the seal 46 does not contact the shaft 32, any fluid, such as oil lubricating the bearings 40 and 42, is prevented from leaking out of the seal 46. The grooves 140 are used to trap any fluid that may escape the bearings 40 and 42. The drive scroll 12, the driven scroll 24, and the tip seal 104 are also shown in this particular view.

Figure 8:
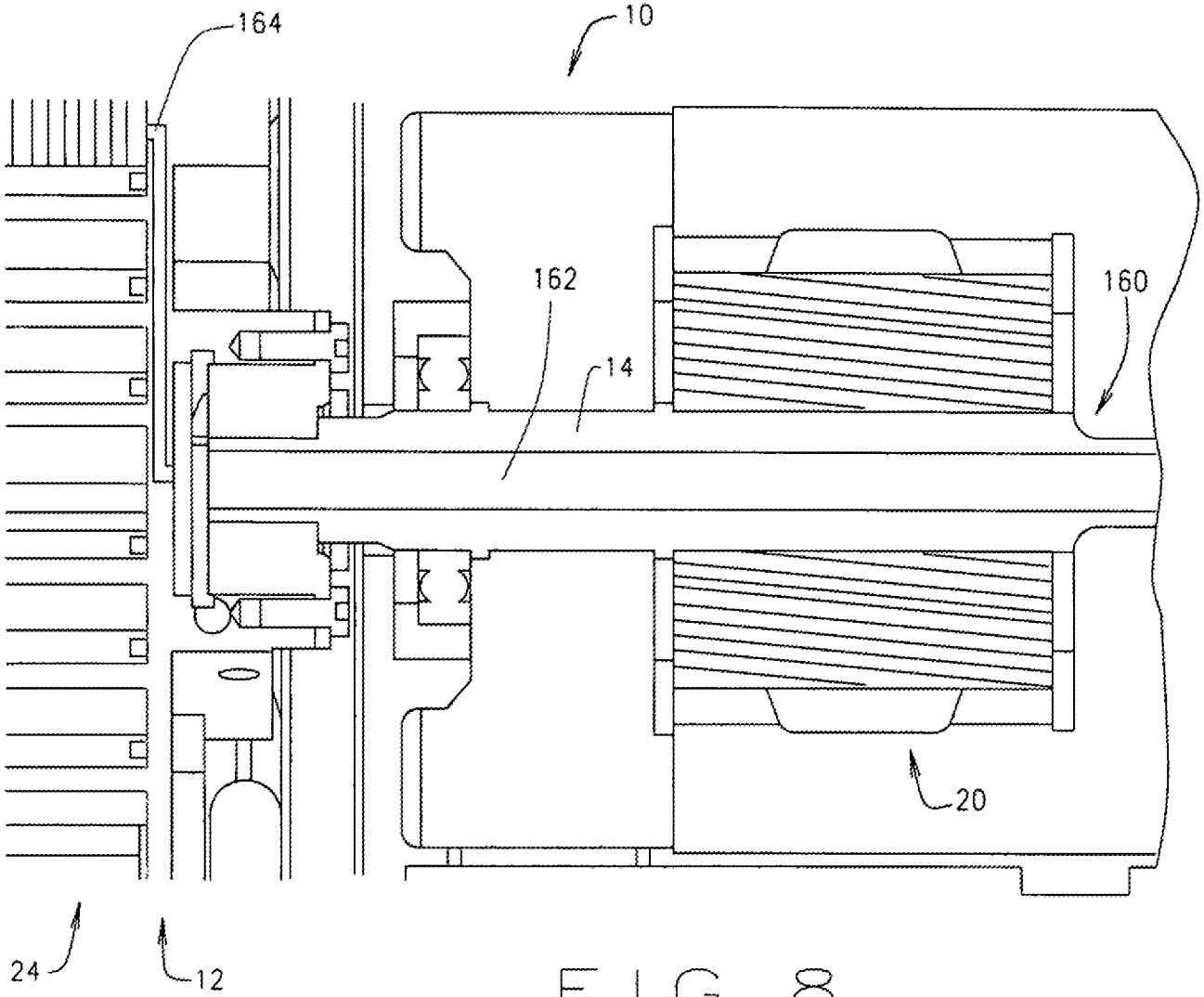
FIG. 8 shows a sectional view of an inlet of the co-rotating scroll device of the present disclosure.

FIG. 8 illustrates an alternate embodiment of an inlet (or discharge) 160 to the device 10 through the center shaft 14 of the motor 20 with the shaft 14 being a hollow shaft 162. A cross hole 164 is used to deliver working fluid (not shown) to an outer area of the scrolls 12 and 24. A labyrinth or shaft seal (not shown) may be used to seal working fluid from ambient air.

Figure 9:
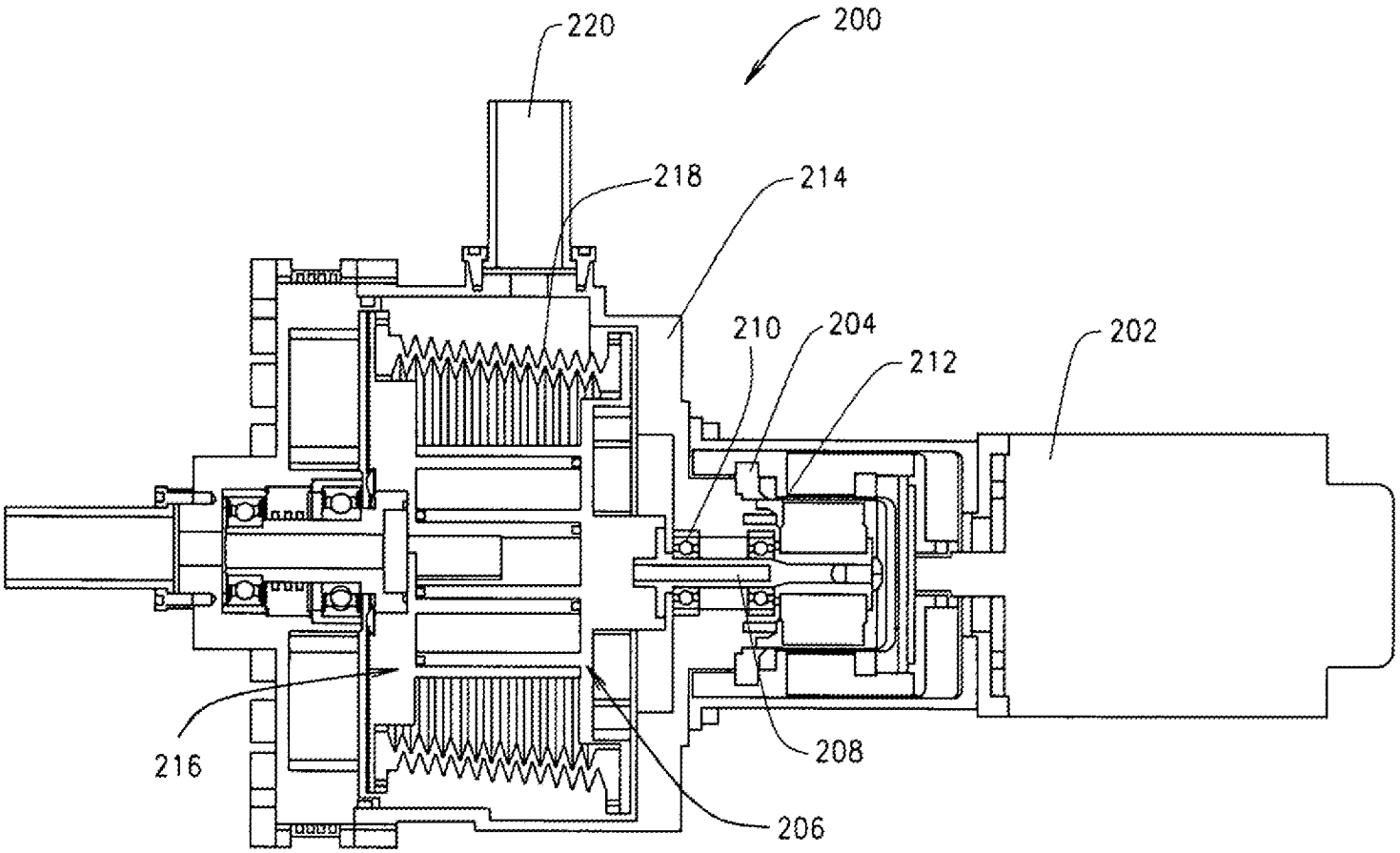
FIG. 9 shows a cross-sectional view of another embodiment of a co-rotating scroll device having a bellows instead of idler shafts.
Figure 10:
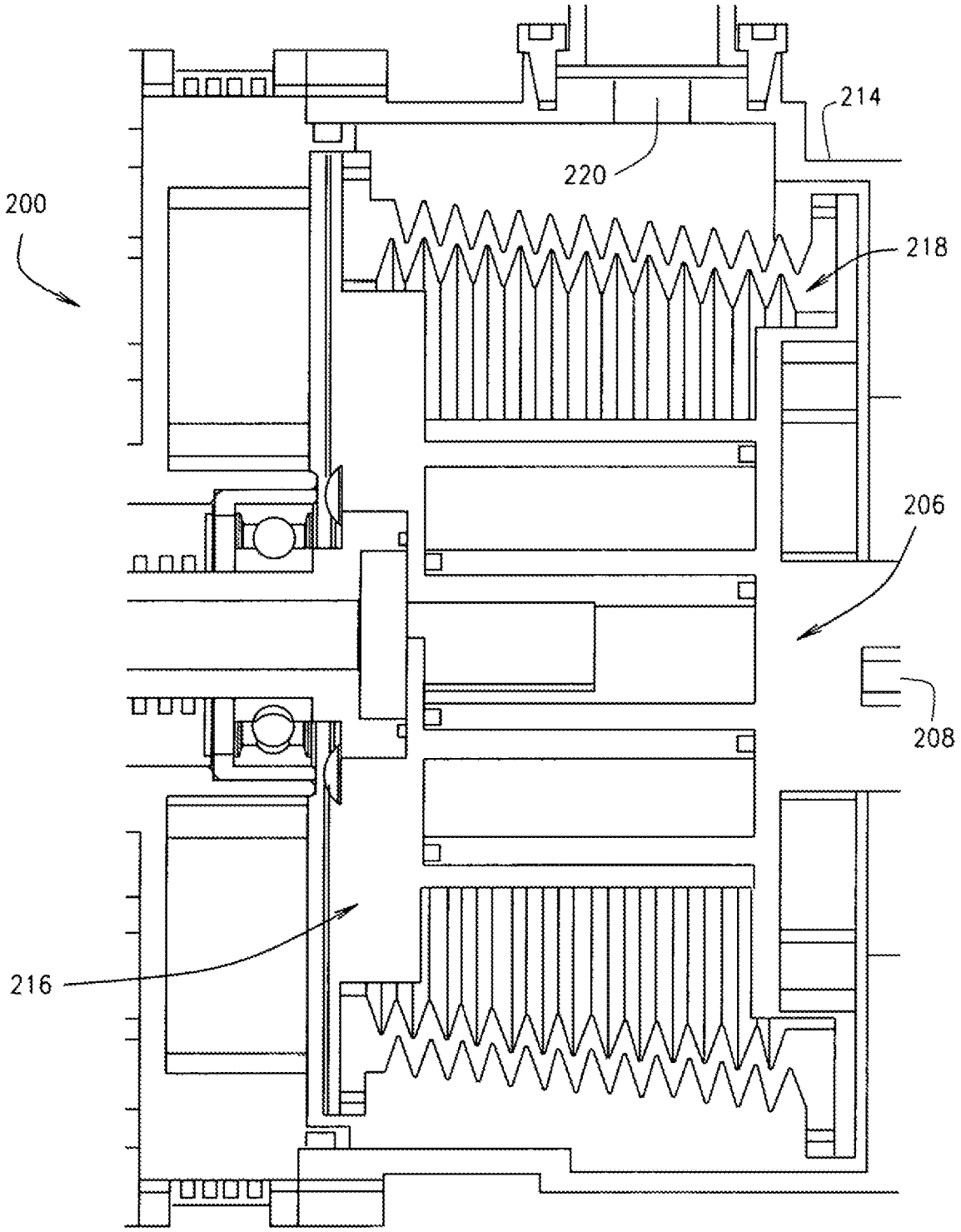
FIG. 10 shows an enlarged sectional view of the bellows shown in FIG. 9.

Referring now to FIGS. 9 and 10, another embodiment of a co-rotating scroll 200 constructed according to the present disclosure is depicted. The co-rotating scroll 200 has a motor 202 that is isolated from any working fluid (not shown) of the scroll 200 by use of a magnetic coupling 204. A drive scroll 206 is driven by a center shaft 208 connected to the magnetic coupling 204. The center shaft 208 is supported by a front bearing 210 and a rear bearing 212. The bearings 210 and 212 are mounted in a housing 214. A second scroll or driven scroll 216 is driven by the drive scroll 206. A bellows 218 is positioned between the drive scroll 206 and the driven scroll 216. The bellows 218 is used in place of any idler shafts to drive the driven scroll 216. The bellows 218 is stiff in the angular or torsional direction, but is flexible in the radial direction. This transmits torque from the drive scroll 206 to the driven scroll 216. This also provides an offset between an axis of rotation between the scrolls 206 and 216. The housing 214 encloses the scrolls 206 and 216, the bearings 210 and 212, and the bellows 218 and ensures that there is no leakage of the working fluid to the atmosphere. The co-rotating scroll 200 also has an inlet 220. The co-rotating scroll 200 is an example of another construction of aligning and driving the driven scroll 216 without the use of any idler shafts, such as the idler shafts 26.

Figure 11:
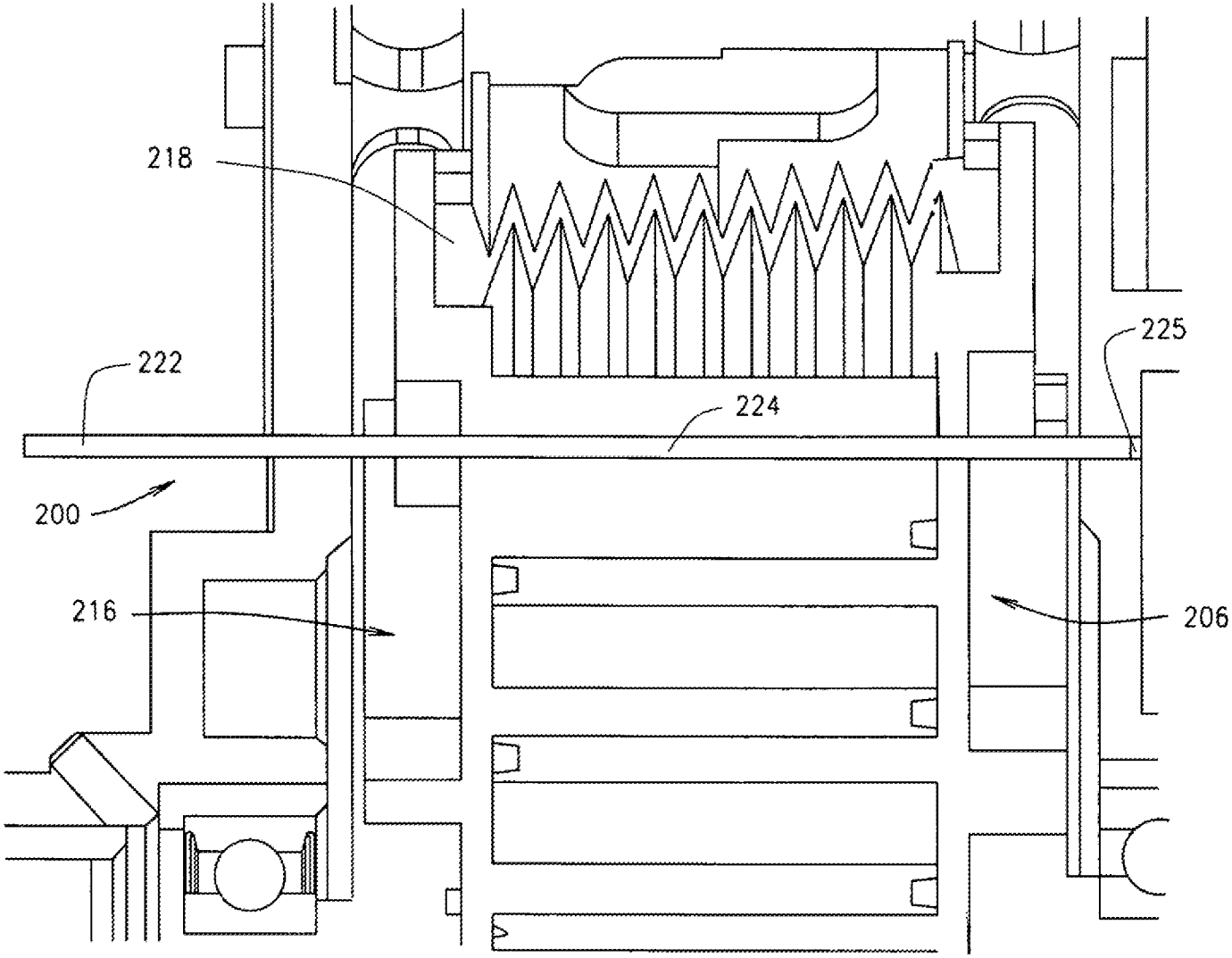
FIG. 11 shows a co-rotating scroll device having a pin for positioning a drive scroll relative to a driven scroll.

One disadvantage associated with the use of the co-rotating scroll 200 is that it is difficult to align the drive scroll 206 and the driven scroll 216. Idler shafts achieve the necessary alignment easily since bearing bores can be precision located relative to the scroll profile. To overcome this alignment problem in the co-rotating scroll 200, one or more bellows alignment pins 222, as illustrated in FIG. 11, are employed. The pin 222 is inserted into a precision machined hole 224 so that the precise desired alignment is achieved during assembly of the co-rotating scroll 200. The pin 222 is inserted during assembly prior to the bellows 218 and the housing 214 being completely tightened. Use of the pin 222 fixes the location of the driven scroll 216 relative to the driving scroll 206. The pin 222 is removed during the assembly process so that the scrolls 206 and 216 are free to rotate during use of the scroll 200.

Figure 12:
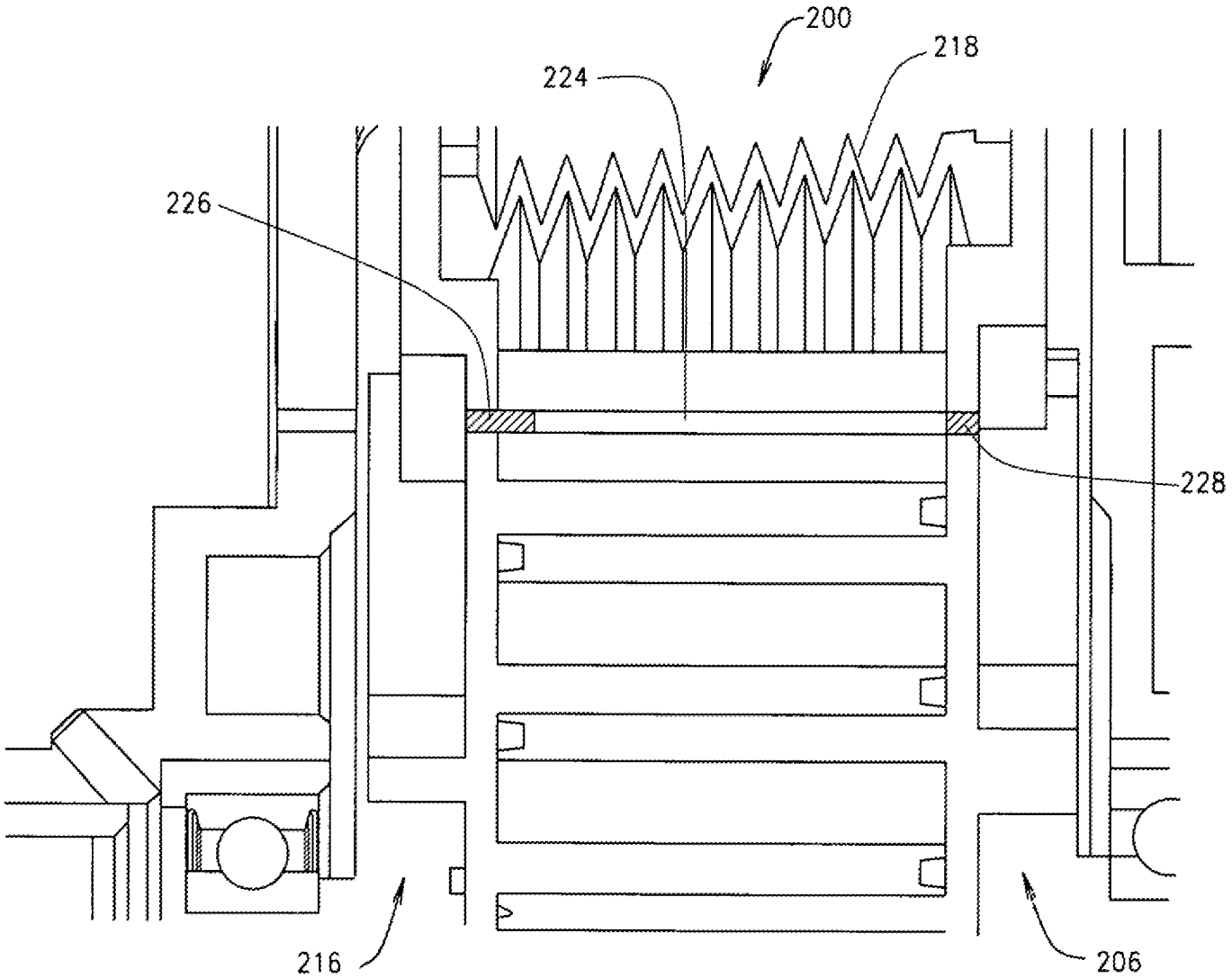
FIG. 12 shows the co-rotating scroll device of FIG. 11 having the pin removed.

In FIG. 12, a first plug 226 is used to plug the hole 224 and a second plug 228 is used to plug the hole 224 after the pin 222 has been removed during the assembly of the co-rotating scroll 200. The plugs 226 and 228 are used so that there is no leakage to the atmosphere of any working fluid after the pin 222 has been removed and the co-rotating scroll 200 is placed into service or use. Again, by using the pin 222, the scrolls 206 and 216 are capable of being aligned.

As has been discussed and shown, pre-loading the shaft bearing with a spring so that the axial load on the idler shaft bearings is reduced provides for the use of smaller bearings and improved longevity of the bearings. Routing the inlet or discharge in the case of an expander through the shaft to simplify the separation of working fluid from surrounding ambient air is beneficial. Driving and aligning one scroll with respect to another scroll using a flexible bellows instead of idler shafts is also beneficial in the design of co-rotating scrolls. Also, being able to position one scroll with respect to the other scroll using alignment pins during assembly assists in reducing or eliminating any alignment problems. This also allows a co-rotating scroll device that has a flexible bellows design or construction.

Figure 13:
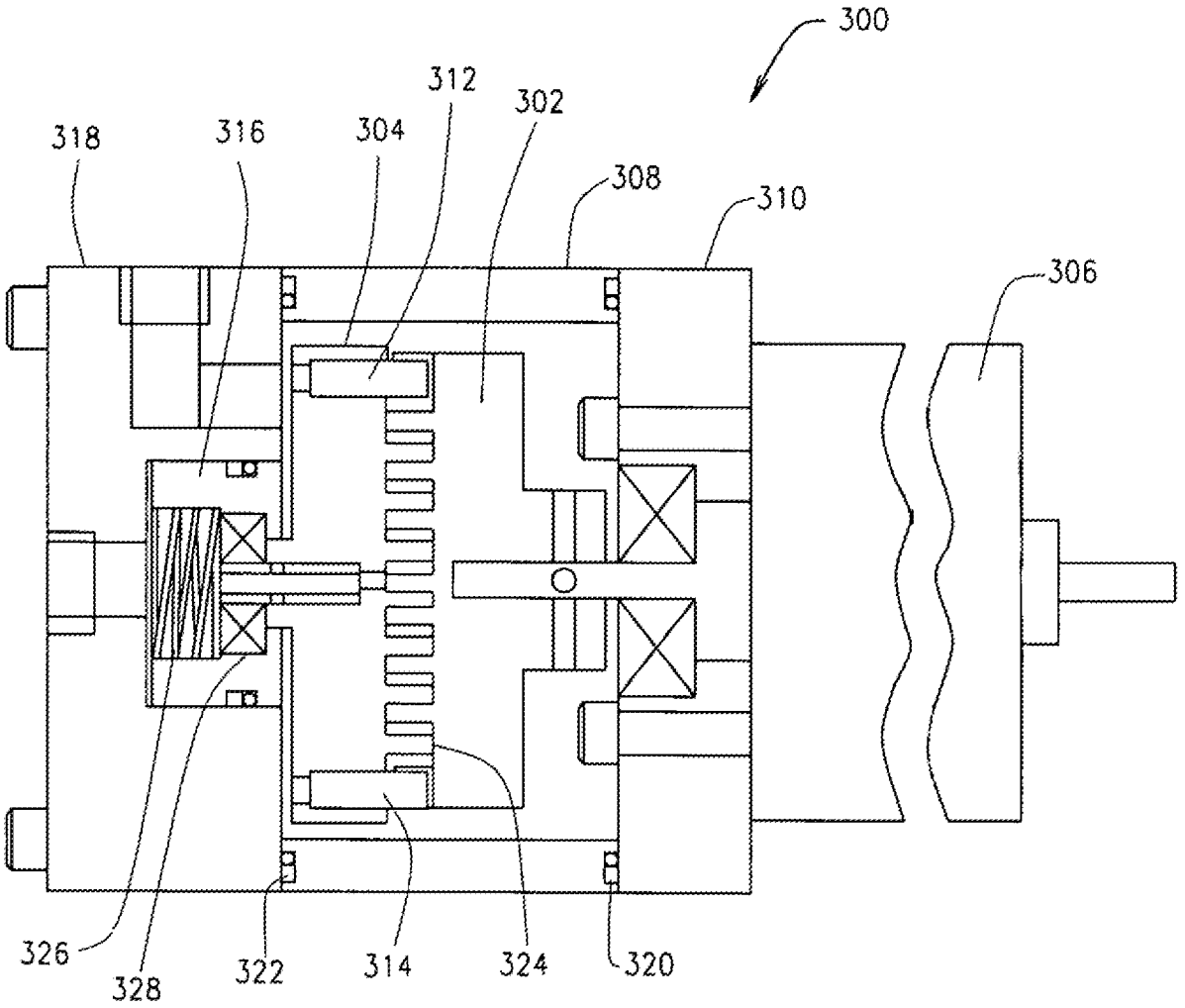
FIG. 13 shows another embodiment of a co-rotating scroll constructed according to the present disclosure in which alignment slots and pins are used to align a drive scroll relative to a driven scroll.

With reference now to FIG. 13, another embodiment of a co-rotating scroll device 300 is shown. The co-rotating scroll device 300 comprises a drive scroll 302 that is used to drive a driven scroll 304. The drive scroll 302 is connected to a motor 306. The drive scroll 302 is contained within a housing 308. The motor 306 may be attached to a motor mount 310. A pin 312 is inserted or pressed into the driven scroll 304 to align the scrolls 302 and 304 with respect to each other. Another pin 314 is also used to align the scrolls 302 and 304. Although two pins 312 and 314 are shown in this particular view, as will be explained in detail herein, it is possible that more pins may be used to align the two scrolls 302 and 304.

The co-rotating scroll 300 also has other components such as a bearing plate 316, a discharge plate 318, a pair of O-rings 320 and 322 to seal the scroll 300, a tip seal 324, a centering spring 326, and a bearing 328. However, the important component with respect to the scroll 300 is the use of the pins 312 and 314. Also, other components are shown, but such components have not been identified.

Figure 14:
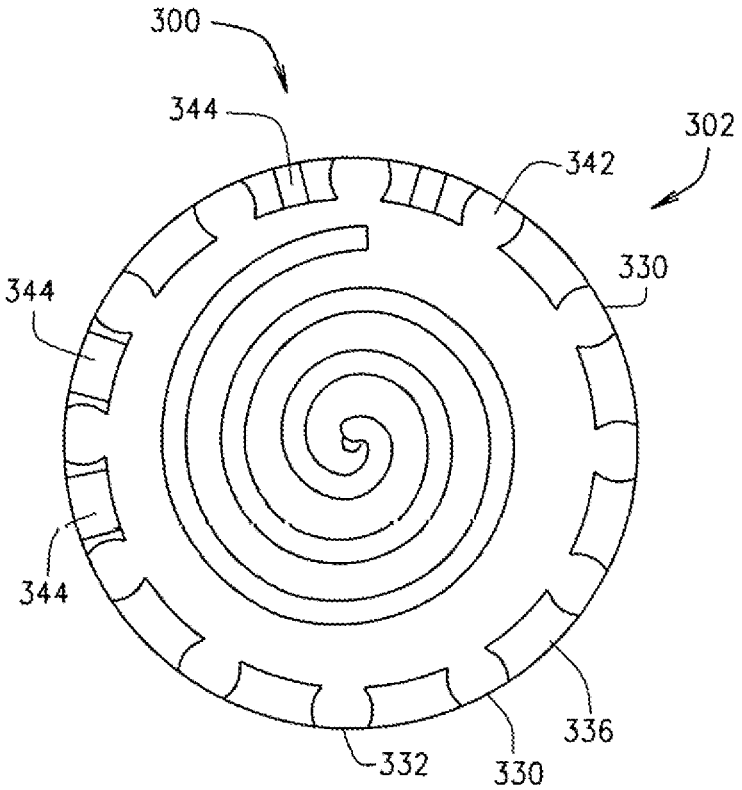
FIG. 14 shows a side view of a drive scroll used in the co-rotating scroll shown in FIG. 13.

FIG. 14 illustrates the drive scroll 302 having twelve slots 330 positioned around the scroll 302. The slots 330 are used to use the pins 312 and 314. Although twelve slots 330 are shown, it is possible to have fewer slots, such as any number of slots from three to eleven. The slots 330 are rounded and have a diameter such that when a pin 312 (FIG. 13) is pressed into the driven scroll 304 (FIG. 13), the two scrolls 302 and 304 will be aligned with respect to each other. The slots 330 also has a lead in "I" configuration 332 so that the transition into the slots 330 by the pin 312 is smooth. The pin 312 is pressed into a hole 344 in the scroll 302. The pin 312 has a diameter such that the diameter of the slots 330 and the diameter of the pin 312 are equivalent to the desired offset between the scrolls 302 and 304.

Figure 15:
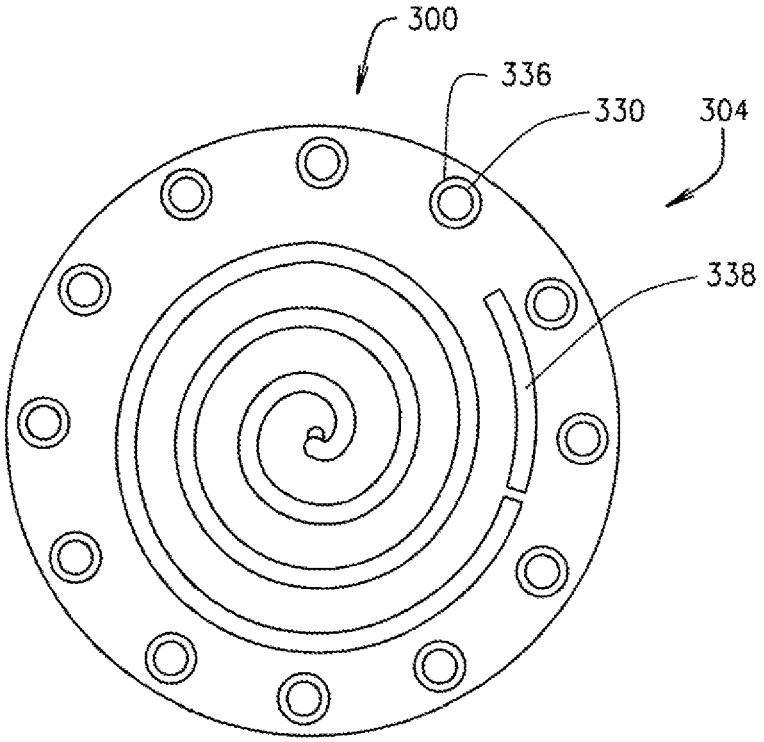

With reference now to FIG. 15, the slots 330 are shown being placed in a raised portion 336 of the drive scroll 302 for dynamically balancing the drive scroll 302. A rib 338 is also located on the driven scroll 304 for balancing the driven scroll 304.

By use of the rounded slots 330 and the pins 312 and 314, a co-rotating scroll may be constructed for aligning the drive scroll 302 and the driven scroll 304. The lead in configuration 332 in the rounded slots 330 is also used to provide for smooth insertion of the pins 312 and 314 into the rounded slots 330. The scrolls 302 and 304 may be balanced by cutting slots into the raised portion of the rounded slots 330.

As has been described, using a series of rounded slots and pins provides for driving and aligning the drive scroll and the driven scroll. The use of a lead into the rounded slots provides for a smooth entry of the pins into the slots. Also, the drive scroll may be balanced by cutting slots into the raised portion of the rounded slots. Ribs may also be used to dynamically balance the driven scroll.

Figure 16:
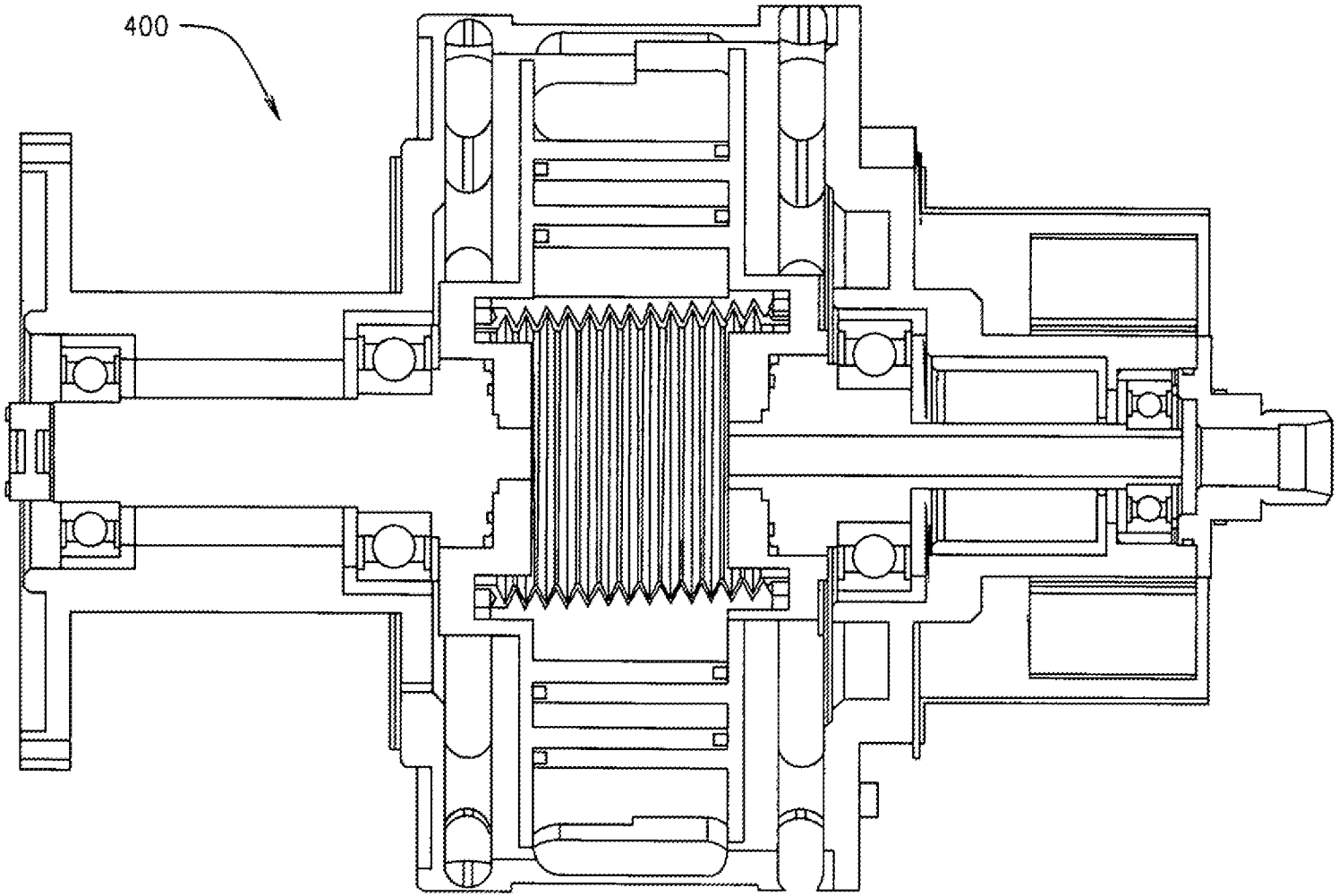
FIG. 16 shows a bellows providing to add flexure to the internal aspects of the scrolls.

FIG. 16 shows the application of a bellows or a flexure means internally of the scroll to prevent leakage of the working fluid during usage of the device. Also the bellows helps to maintain scroll alignment and to transfer torque.

From the aforementioned description, a co-rotating scroll device from the machine class of scroll compressors, pumps, and expanders has been described. This co-rotating scroll device is capable of expanding or compressing a fluid cyclically to evacuate a line, device, or space connected to the co-rotating scroll device without intrusion of the nearby atmosphere. The co-rotating scroll device receives its motive power directly from a motor or alternatively from a motor connected to a magnetic coupling, further minimizing the incidence of atmospheric intrusion within the housing and the working fluid. The present disclosure and its various components may adapt existing equipment and may be manufactured from many materials including but not limited to metal sheets and foils, elastomers, steel plates, polymers, high density polyethylene, polypropylene, polyvinyl chloride, nylon, ferrous and non-ferrous metals, various alloys, and composites.

From all that has been said, it will be clear that there has thus been shown and described herein a co-rotating scroll device. It will become apparent to those skilled in the art, however, that many changes, modifications, variations, and other uses and applications of the subject co-rotating scroll device are possible and contemplated. All changes, modifications, variations, and other uses and applications which do not depart from the spirit and scope of the disclosure are deemed to be covered by the disclosure, which is limited only by the claims which follow.

What is claimed is:

1. A co-rotating scroll comprising:

a motor having a drive shaft;

a drive scroll connected to the drive shaft, the drive scroll comprising a first bearing having a first centerline and comprising a first alignment aperture;

a driven scroll connected to the drive scroll, the driven scroll comprising a second bearing having a second centerline offset from the first centerline and also comprising a second alignment aperture, the first alignment aperture alignable with the second alignment aperture; and an eccentric idler shaft comprising:

a first portion operably connected to the first bearing; and a second portion operably connected to the second bearing, the second portion offset from the first portion;

wherein each of the first portion and the second portion have a hole provided therein.

2. The co-rotating scroll of claim 1, further comprising a second eccentric idler shaft and a third eccentric idler shaft.

3. The co-rotating scroll of claim 2, wherein the eccentric idler shaft, the second eccentric idler shaft, and the third eccentric idler shaft are configured to limit movement of the driven scroll relative to the drive scroll.

4. The co-rotating scroll of claim 1, wherein:

the drive scroll further comprises a first involute and a balance weight positioned on the first involute to dynamically balance the drive scroll.

5. The co-rotating scroll of claim 4, wherein the driven scroll further comprises a second involute and a counter-weight positioned on the second involute to dynamically balance the driven scroll.

6. The co-rotating scroll of claim 4, further comprising a second balance weight, and wherein the balance weight and the second balance weight are located coaxially with the first involute.

7. The co-rotating scroll of claim 1, further comprising a compression chamber formed between a first involute of the drive scroll and a second involute of the driven scroll.

8. The co-rotating scroll of claim 7, wherein the first involute comprises a first tapered tip seal in contact with the driven scroll, and the second involute comprises a second tapered tip seal in contact with the drive scroll, the first tapered tip seal and the second tapered tip seal configured to seal the compression chamber.

9. The co-rotating scroll of claim 1, wherein the first bearing and the second bearing are grease bearings.

10. The co-rotating scroll of claim 9, wherein each of the first bearing and the second bearing comprises a bearing shield.

11. The co-rotating scroll of claim 1, wherein one or more of the first bearing and the second bearing is retained in place by a bearing cover.

12. The co-rotating scroll of claim 1, wherein the hole in the first portion of the eccentric idler shaft is empty.

13. The co-rotating scroll of claim 1, wherein the hole in the second portion of the eccentric idler shaft is empty.

14. The co-rotating scroll of claim 1, further comprising a lock nut and a lock washer configured to retain the eccentric idler shaft on the first bearing.

15. The co-rotating scroll of claim 1, further comprising a lock nut and a lock washer configured to retain the eccentric idler shaft on the second bearing.

16. A co-rotating scroll device comprising:

a drive scroll comprising a first alignment aperture, a first involute and a first tapered tip seal;

a driven scroll comprising a second alignment aperture, a second involute and a second tapered tip seal, the first alignment aperture alignable with the second alignment aperture;

a compression chamber formed between the first involute and the second involute, with the first tapered tip seal positioned adjacent the driven scroll and the second tapered tip seal positioned adjacent the drive scroll;

a plurality of idler shafts extending from the drive scroll to the driven scroll, each idler shaft supported by an idler shaft bearing in the drive scroll and an idler shaft bearing in the driven scroll;

a drive shaft operably connected to the drive scroll, the drive shaft supported by a plurality of drive shaft bearings; and an electric motor operably connected to the drive shaft, the electric motor configured to drive the drive scroll via the drive shaft.

17. The co-rotating scroll device of claim 16, wherein the first tapered tip seal has a maximum width adjacent the driven scroll, and the second tapered tip seal has a maximum width adjacent the drive scroll.

18. The co-rotating scroll device of claim 16, wherein the first tapered tip seal is self-actuating when the electric motor drives the drive scroll.

19. A co-rotating scroll device comprising:

a drive scroll comprising a first alignment aperture, a first involute and three first idler shaft bearings evenly spaced around the first involute;

a driven scroll comprising a second alignment aperture, a second involute and three second idler shaft bearings evenly spaced around the second involute, the first alignment aperture alignable with the second alignment aperture;

three eccentric idler shafts, each extending between one of the three first idler shaft bearings and one of the three second idler shaft bearings;

a chamber formed between the first involute and the second involute; and a first tapered tip seal positioned between the first involute and the driven scroll, and a second tapered tip seal positioned between the second involute and the drive scroll.

20. The co-rotating scroll device of claim 19, wherein the first tapered tip seal is tapered away from the driven scroll, and the second tapered tip seal is tapered away from the drive scroll.

* * * * *